US006228321B1

(12) United States Patent
Umetsu et al.

(10) Patent No.: US 6,228,321 B1
(45) Date of Patent: May 8, 2001

(54) BOX ANNEALING FURNACE METHOD FOR ANNEALING METAL SHEET USING THE SAME AND ANNEALED METAL SHEET

(75) Inventors: Akira Umetsu; Hiroyuki Kaito; Kusuo Furukawa; Hidehiko Kimishima, all of Tokyo (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/356,994

(22) Filed: Jul. 20, 1999

(30) Foreign Application Priority Data

Jul. 28, 1998 (JP) ..... 10-212177
Jul. 28, 1998 (JP) ..... 10-212178

(51) Int. Cl.[7] ..... C21D 1/06
(52) U.S. Cl. ..... 266/256; 148/582
(58) Field of Search ..... 266/249, 256; 148/626, 582, 601

(56) References Cited

U.S. PATENT DOCUMENTS 4,210,469 * 7/1980 Shimada et al. ..... 266/256

FOREIGN PATENT DOCUMENTS 57-089438 * 6/1982 (JP) ..... 148/626
402236229 * 9/1990 (JP) ..... 148/626

* cited by examiner

*Primary Examiner*—Scott Kastler
(74) *Attorney, Agent, or Firm*—Austin R. Miller

(57) ABSTRACT

A box annealing furnace for annealing a metal sheet includes an oxygen removal unit for removing oxygen from the atmosphere in a box annealing furnace, with a gas circulation system for withdrawing atmosphere from the box annealing furnace during annealing, treating the gas, and for refeeding the deoxidized gas to the box annealing furnace. The box annealing furnace may also include a moisture removal unit for removing moisture from the gas. The oxygen removal unit and the moisture removal unit can reliably remove oxygen and moisture from the gas and suppress the formation, during annealing, of oxide film on a ferrous metal sheet.

16 Claims, 11 Drawing Sheets

F1G. 10
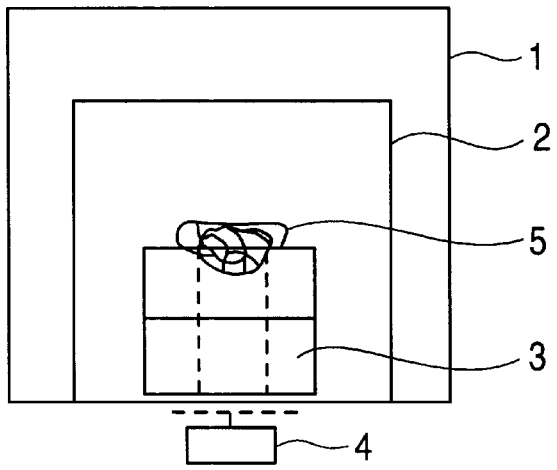
F1G. 11
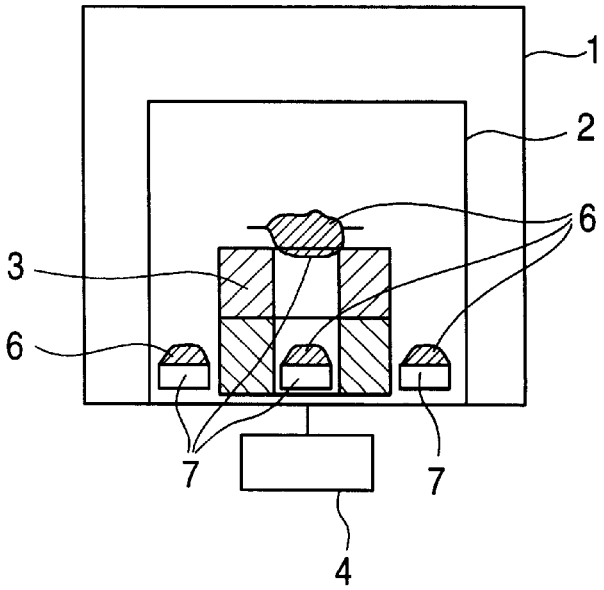

BOX ANNEALING FURNACE METHOD FOR ANNEALING METAL SHEET USING THE SAME AND ANNEALED METAL SHEET

BACKGROUND OF THE INVENTION

1. Field of the Invention

This invention relates to a box annealing furnace for annealing metal sheets such as cold-rolled carbon steel sheets, for example. This invention also relates to a method for making metal sheets including strips and coils, in addition to cut sheets, all with the use of a furnace of this invention. The invention further relates to the cold-rolled and annealed products of the method.

2. Description of the Related Art

Cold-rolled stainless steel and heat-resisting steel sheets can be produced by hot rolling, hot annealing and pickling, cold rolling-finish annealing and pickling (cold-rolled annealing and pickling), and subsequent skin-pass rolling. The finish annealing and pickling procedure generally comprises a continuous annealing, pickling or continuous bright annealing.

Although such a continuous line is useful for mass production, it is not always appropriate for small, batch-type production. Also, a continuous line is not appropriate for production of cold-rolled stainless steel and heat-resisting steel sheets using a cold rolling production line for carbon steel or general steel. Instead of finish annealing (cold-roll annealing) and pickling requiring huge facilities, the use of box annealing (also called "bell annealing" or "batch annealing") is economically advantageous in many cases.

A cold-rolled stainless steel and heat-resisting steel sheet or coil, however, is subjected to finishing annealing for a long time in a conventional box annealing procedure in which the oxygen content and dew point in the furnace atmosphere are not decreased sufficiently. Thus, an oxide film having a thickness of 4,000 Å or more may be formed on the steel during finish annealing. The oxide film causes severe defects in the stainless steel and heat-resisting steel sheet, one of which is a surface discoloration called temper discolor. Another serious defect resides in deterioration of corrosion resistance (see FIG. 4 discussed hereinafter). Accordingly, box annealing is not presently used as finish annealing in processes for making cold-rolled stainless steel and heat-resisting steel sheets.

Among cold-rolled steel sheets, temper discolor is also observed in high-manganese steel (manganese content: 0.5 to 1.0 percent by weight), and in high niobium steel (niobium content: 0.2 to 0.5 percent by weight). For example, as shown in FIG. 7, annealing of high manganese steel in a HN (hydrogen 7 percent by volume and nitrogen 93 percent by volume) gas annealing atmosphere under soaking conditions of 680° C. and 30 hours creates a yellowish-brown temper discolor in a region 20 which is approximately 150 to 300 mm distant from the sheet edges. Further, a white temper discolor occurs in region 21, having a width of 50 mm from the sheet edges.

Proposed methods for preventing such temper discolor phenomenon include physical and chemical removal of the oxygen source, for example, improved sealing of the furnace and reduced residual air content in the furnace by evacuation of the gas from the furnace prior to annealing. In addition, Japanese Patent Application Laid-Open No. 54-102222 discloses placement of pure copper in the furnace to remove $H_2O$ by a reducing reaction. Although the pure copper reliably absorbs oxygen from the furnace atmosphere by oxidation at an initial stage of the annealing process, the resulting copper oxide becomes reduced during a subsequent high-temperature soaking step, and evolves oxygen due to the weak affinity that exists between copper and oxygen. The oxygen gas evolved in the furnace atmosphere causes surface oxidation of the steel during cooling.

OBJECT OF THE INVENTION

Accordingly, it is an object of the invention to provide a box annealing furnace capable of reliably and continuously removing oxygen and moisture from the furnace atmosphere, and a method for making a cold-rolled annealed metal sheet using a box annealing furnace in which formation of oxide film on the steel is reduced to an insignificant level during the box annealing process.

Other objects and advantages of the invention will become apparent to those skilled in the art from the drawings, detailed description and appended claims.

SUMMARY OF THE INVENTION

The box annealing furnace is specially effective for annealing a metal sheet by use of an oxygen removal means for removing oxygen from the gas that is present in the box annealing furnace, or in the gas circulation system that is connected to the furnace for evacuating gas from the box annealing furnace. It is also specially effective for refeeding the gas to the box annealing furnace after it has been processed.

This invention further relates to a method for annealing a cold-rolled metal sheet by positioning the metal sheet in a box annealing furnace, introducing treatment gas into the furnace according to a special pattern, and heating the metal sheet according to a special heating pattern.

Another important feature of the invention is to create a special annealing in the novel box annealing furnace of this invention.

BRIEF DESCRIPTION OF THE DRAWINGS

FIG. 10 is a schematic cross-sectional view of one embodiment of a box annealing furnace of the invention;

FIG. 11 is a schematic cross-sectional view of another embodiment of a box annealing furnace of the invention;

DETAILED DESCRIPTION OF THE INVENTION

Figure 1:
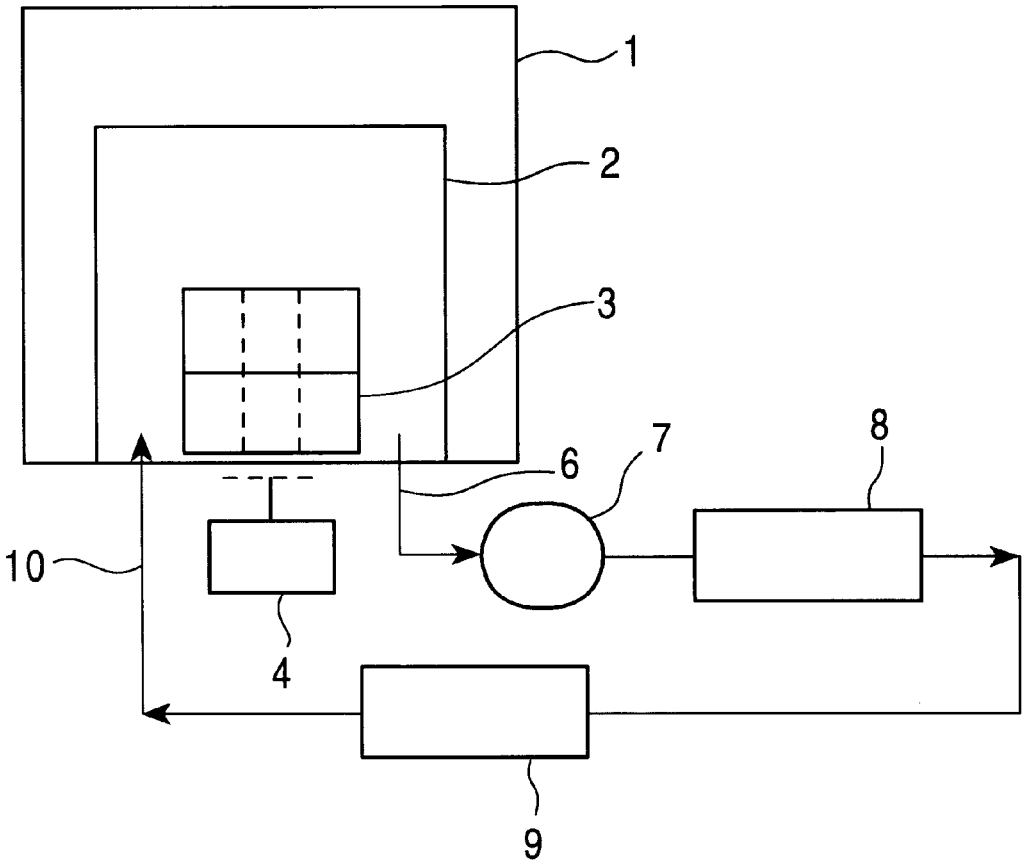
FIG. 1 is a block diagram of one embodiment of a box annealing furnace in accordance with this invention.

Although particular forms of this invention have been selected for illustration in the drawings, and although specific terms are used in this specification for the sake of clarity and for describing the apparatus and method, the scope of this invention is defined in the appended claims and is not intended to be limited either by the drawings selected or specific terms used in the specification.

In that regard, the term "metal sheet" as sometimes used herein includes not only cut sheets, but also metal strips and metal coils.

Turning to the invention description, a gas circulation system is provided which has an inlet and an outlet, both preferably connected into the bottom of the box annealing furnace. The gas circulation system has a gas evacuation means for evacuating and treating gas from the furnace. The gas evacuation means is preferably a blower. The oxygen removal means is preferably a deoxidizing unit which contains either a strong deoxidizing metal having higher affinity for oxygen than that of iron, or alternatively, a catalytic substance for promoting the reaction of oxygen and hydrogen, or both, when the annealing atmosphere contains hydrogen. Hereinafter, such strong deoxidizing metals and catalytic substances are referred to generically as deoxidizers.

The strong deoxidizing metal may be solid or liquid.

The oxygen removal means may include a heating unit for promoting the reaction, if necessary.

Preferably, the deoxidizing gas circulation system includes an oxygen removal means and a moisture removal means for removing moisture in the gas. The moisture removal means is preferably a dryer containing a desiccant which adsorbs water, and may include a cooling unit for promoting moisture adsorption, if necessary or desired. The cooling unit is preferably operated at about 200° C. or less.

Preferably, the gas in the box annealing furnace is drawn out and deoxidized by the gas circulation system, and substantially oxygen-free gas is refed into the box annealing furnace through the deoxidizing unit. Thus, there is frequent contact of the furnace gas with the deoxidizer, and oxygen in the furnace gas can accordingly be effectively removed entirely or controlled at a low level. Accordingly, the amount of oxygen in the furnace gas can be reliably reduced during an initial stage of the annealing (low-temperature heating stage) and also during subsequent annealing stages.

Since the gas in the gas circulation system is also circulated in a dryer, moisture in the air which is introduced into the furnace when the box annealing furnace is assembled or loaded, and moisture already trapped in the steel or other material to be annealed, is effectively removed by the dryer. Thus, the dew point in the furnace atmosphere can be rapidly decreased.

The oxygen removal means of the invention may be a metallic deoxidizer having a higher affinity for oxygen than that of iron. Preferably, the metallic deoxidizer is shaped so as to be highly permeable to gas and moisture introduced into the furnace prior to annealing. Such a configuration facilitates contact of the furnace gas with the deoxidizer and removal of oxygen from the furnace gas by reaction with the deoxidizer. Thus, oxygen can be effectively removed from the furnace gas even at an initial stage of the annealing procedure.

The preferable deoxidizing metals, having higher affinity for oxygen than that of iron, have standard free energies of oxide formation of no greater than about −110 kcal/1 mol of $O_2$ at 200° C. Examples of such metals include but are not limited to chromium, silicon, titanium, vanadium, manganese, aluminum, lithium, magnesium, and calcium. These metals may be used alone or in any combination with each other.

Preferable shapes of the strong deoxidizing metal have a large contact area with the circulating gas and have excellent gas permeability. The ratio S/V of the average surface area S ($mm^2$) to the average volume V ($mm^3$) of the strong deoxidizing metal is about 0.2 or more. Examples of the preferable shapes of the strong deoxidizing metal are a granule having an average diameter of about 30 mm or less, a wire having an average diameter of about 15 mm or less, and a sponge having an average porosity of about 20% or more.

Preferably, the deoxidizer is present in the furnace in an amount of about 20 to 2,000 g/ton. Oxidation of the metal sheet may be allowed to occur if the amount of deoxidizer metal is less than the lower limit of about 20, and the removal of oxygen and moisture reaches saturation if the amount exceeds the upper limit of about 2000 g/ton.

Since oxygen and moisture in the furnace gas can be thoroughly removed even at a low-temperature at an initial stage of the annealing procedure, temper discolor can be reliably prevented.

The box annealing furnace of the invention can be readily formed by modification of a conventional box annealing furnace used for cold-rolled steel and heat-resisting steel sheets, such as carbon steel sheets. Such a modification is significantly more economical than the use of a continuous line. Furthermore, formation of the oxide film can be suppressed enough to avoid problems in use. Thus, for example, a cold-rolled annealed stainless steel and heat-resisting steel sheet, as a typical example of the invention, has high corrosion resistance.

In the invention, the dryer may be omitted if air is sufficiently purged from an inner cover using, for example, gaseous nitrogen prior to annealing.

Figure 8:
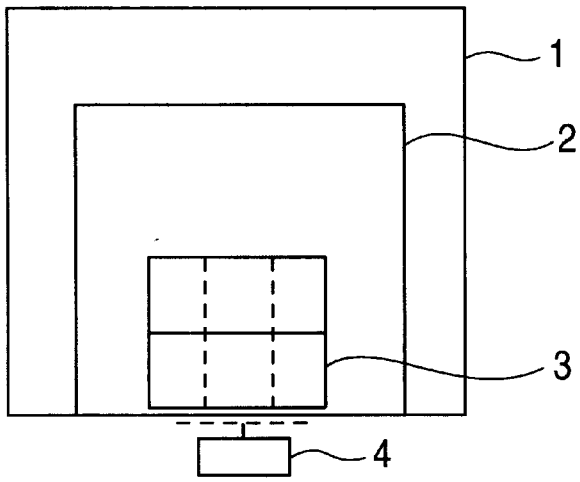
FIG. 8 is a schematic cross-sectional view of a conventional box annealing furnace.

Turning now to the drawings in general and FIG. 1 in particular, there is shown a block diagram of a basic configuration of a box annealing furnace of the invention. This box annealing furnace is a modification of a conventional box annealing furnace as shown in FIG. 8. It has a cover 1, an (optional) inner cover 2 and is shown containing a coil 3, which may be of iron or steel, for example.

The box annealing furnace of FIG. 1 is provided with a gas circulation system having an inlet 6 and an outlet 10 at the furnace bottom. The gas circulation system is provided with a blower 7 as an evacuation means for evacuating the furnace gas, a deoxidizing unit 8 for removing oxygen in the gas, and a dryer 9 as a moisture removal means for removing moisture in the gas, in that order, from inlet 6. The order of succession of blower 7, deoxidizing unit 8, and dryer 9 can be changed in response to the practical circumstances.

Deoxidizing unit 8 preferably uses a deoxidizing metal or a liquid deoxidizing metal such as an aluminum bath, for example. When the annealing atmosphere contains hydrogen, a platinum-palladium catalyst is preferably used to cause or accelerate a reaction between oxygen and hydrogen.

Deoxidizing unit 8 preferably contains the above-mentioned strong deoxidizing metal. Dryer 9 contains a substance for adsorbing water molecules, such as a molecular sieve, or synthetic zeolite, for example.

In FIG. 1, the piping system for feeding atmospheric gas to the furnace is not depicted, inasmuch as it is well known in the art.

The invention is also applicable to a box annealing furnace not having an inner cover 2.

FIG. 10 is a cross-sectional view of an embodiment of the box annealing furnace of this invention. In that embodiment, a coil 3 to be annealed is placed in the furnace, covered with an inner cover 2 spaced within an outer cover 1, and annealed according to a controlled heating pattern using a heat source (not shown in the drawing) provided between the covers 2 and 1. A deoxidizing metal in the form of a sponge 5, having high affinity for oxygen as a deoxidizer, is placed in inner cover 2 prior to annealing.

FIG. 11 is a cross-sectional view of another embodiment of the box annealing furnace of this invention. Instead of the sponge deoxidizing metal, a deoxidizer 6, of granular metal having high affinity for oxygen, is placed in a net metal case 7 having high gas permeability. Each of the box annealing furnaces shown in FIGS. 10 and 11 has a fan 4 for circulating the gas in the furnace to make the furnace environment uniform.

Either form of deoxidizer may be placed at a single position in the furnace as shown in FIG. 10, or at a plurality of positions in the furnace as shown in FIG. 11, depending upon practical annealing conditions.

Examples of the invention will now be described.

EXAMPLE 1

Figure 2:
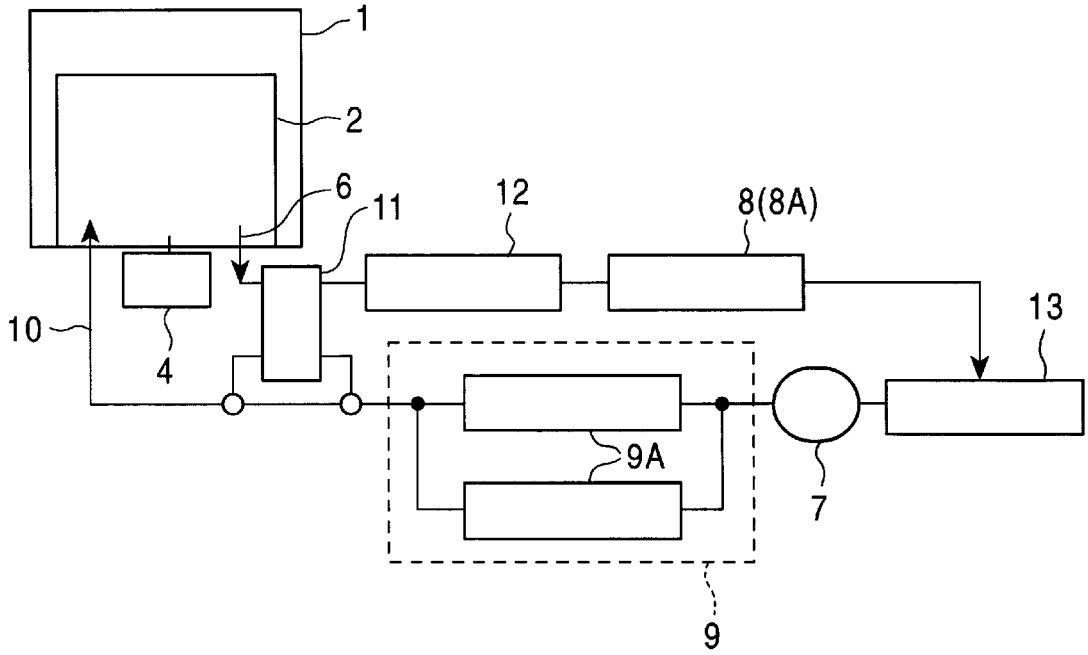
FIG. 2 is another block diagram of a furnace described in Example 1 of the specification.
Figure 3:
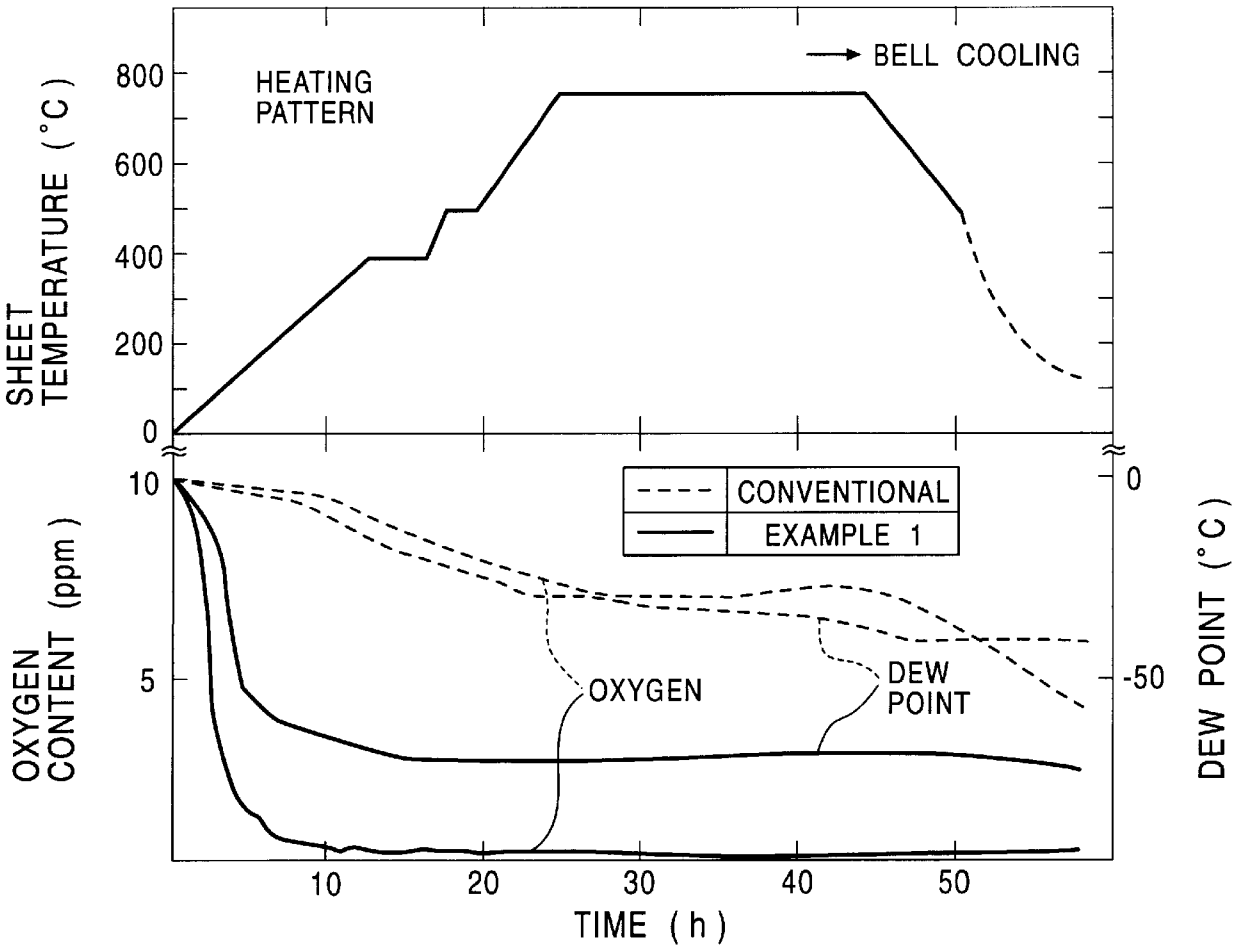
FIG. 3 comprises two combined graphs, one being a graph of a heating pattern taken from Example 1 and a conventional heating pattern, and another being a graph showing changes of oxygen content and dew point in furnace gas.

Three coils (45 tons in total) of cold-rolled heat-resisting steel (SUH409, JIS(Japanese Industrial Standard)-G-4312) sheets having a thickness of 1.2 mm and containing 0.2 to 0.7 percent by weight of titanium were box-annealed in a pure hydrogen gas atmosphere using a box annealing furnace shown in FIG. 2, according to the heating pattern shown in FIG. 3.

As a gas circulation system, an inlet 6, a deoxidizing unit 8, a blower 7, and a dryer 9 were provided in that order, and the flow rate of the circulating gas was controlled to be 200 $Nm^3$/hr. The deoxidizing unit 8 was a titanium deoxidizing unit 8A (see FIG. 2) filled with sponge titanium having an average porosity of 40%. The dryer 9 consisted of two molecular sieve columns 9A filled with synthetic zeolite, arranged in parallel so that one column was used for drying gas and the other was heated for reuse.

At the inlet side of the titanium deoxidizing unit 8A, a heater 12 for heating the gas to about 300° C. or more was provided to facilitate oxidation of titanium. A cooler 13 for cooling the gas to about 200° C. or less was provided between blower 7 and titanium deoxidizing unit 8A to protect blower 7 and to improve dehumidification efficiency of dryer 9. When the furnace temperature was higher than 200° C., the temperature of the gas fed from the outlet 10 to the furnace was lower than the temperature of the gas evacuated from inlet 6 to the gas circulation system, that is, the temperature of the furnace gas. In order to avoid a decrease in the heating rate of the furnace, a convection heat exchanger 11 was placed in the vicinity of inlet 6 and outlet 10 to exchange heat between the gas in inlet 6 and the gas in outlet 10.

The gas evacuated from inlet 6 to the gas circulation system passed through heat exchanger 11 and heater 12 to be heated to about 300° C. or more, and entered titanium deoxidizing unit 8A in which oxygen was removed by the reaction with sponge titanium. The gas was cooled in cooler 13 to about 200° C. or less, and passed through molecular sieve 9A to remove moisture. The gas passed through heat exchanger 11 so that the temperature was controlled to substantially the furnace temperature, and was fed from outlet 10 to the furnace.

FIG. 3 is a graph showing changes of oxygen content and dew point in the furnace gas during the box annealing in Example 1 and a conventional method shown in FIG. 8 for comparison. In the conventional method, the oxygen content is decreased to approximately 7 ppm. In example 1, the oxygen content reached 1 ppm at five hours later (before the sheet temperature reached 300° C.), a level considerably lower than 1 ppm was maintained until the completion of annealing. In the conventional method, the dew point decreased to −40° C. In Example 1, the dew point decreased to −60° C. at the initial stage of annealing (10 hours after the start of the annealing), and this level was maintained to the final stage of the annealing. The dew point in Example 1 further decreased to approximately −70° C. during the cooling step.

Temper discolor was observed on the surface of the annealed conventional sheet, but was not present or observable on the surface of the annealed sheet in Example 1.

Figure 4:
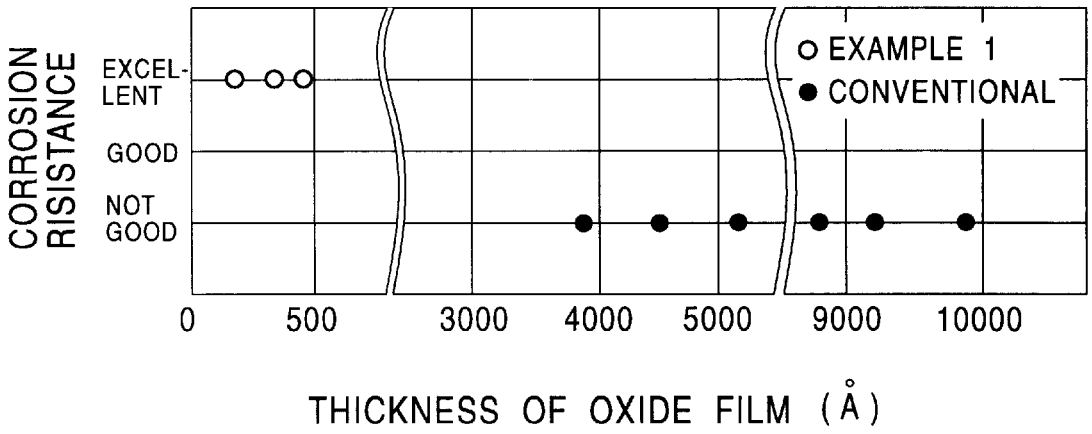
FIG. 4 is a graph showing the relationship between the thickness of an oxide film and corrosion resistance in Example 1, as compared to a conventional example.

FIG. 4 shows the relationship between the thickness of the oxide film and corrosion resistance. The thickness of the oxide film was determined at a position which was approximately 100 mm from the transverse edge of the sheet. It was measured by glow discharge spectroscopy (GDS). The corrosion resistance was evaluated by the number of corroded areas which were generated by a standard salt water (5% sodium chloride, aqueous solution, 35° C.) spray test for 4 hours according to JIS (Japanese Industrial Standard)-Z-2371. (Evaluation: Excellent for 0/$dm^2$, Good for 1 to 10/$dm^2$, Not Good for 11/$dm^2$ or more)

As shown in FIG. 4, the thickness of the oxide film was 4,000 Å to 10,000 Å for the conventional sheet and 200 Å to 500 Å for Example 1 (approximately 1/20 of the thickness of the oxide film of the conventional sheet). Thus, the corrosion resistance in Example 1 was significantly greater than that of the conventional sheet.

EXAMPLE 2

Figure 5:
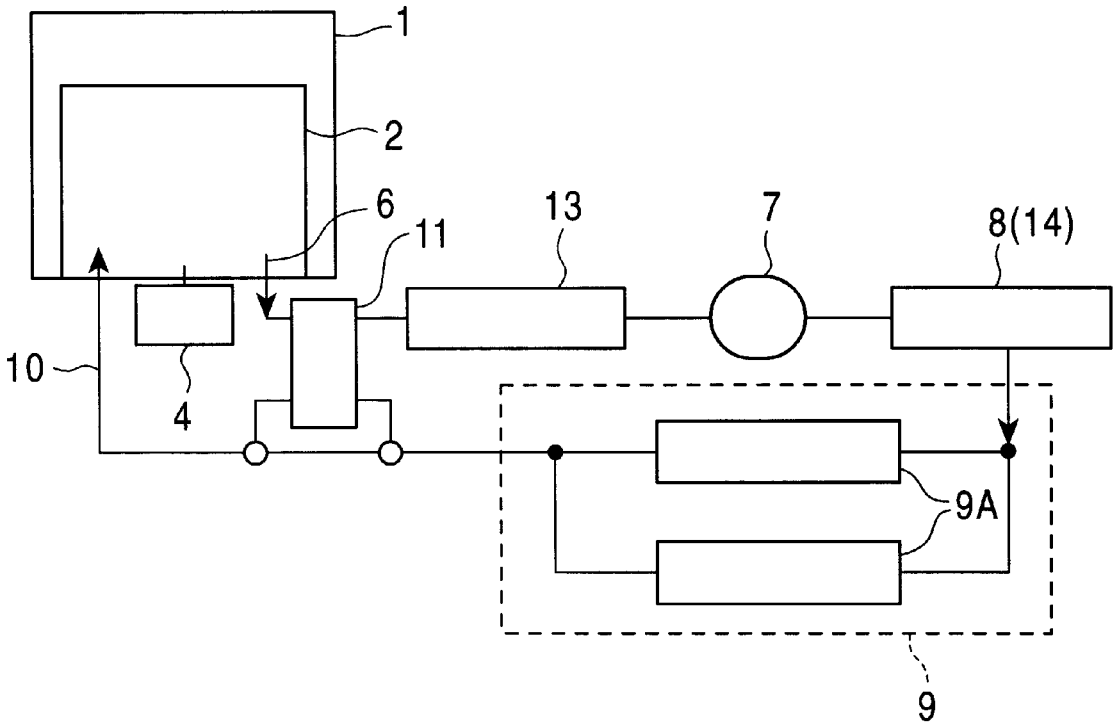
FIG. 5 is a block diagram of a furnace of this invention as used in Example 2 of the specification.

Three coils (45 tons in total) of cold-rolled heat-resisting steel (SUH409, JIS-G-4312) sheets having a thickness of 1.2 mm and containing 0.2 to 0.7 percent by weight of titanium were box-annealed in a (75% by volume hydrogen and 25% by volume nitrogen) mixed gas atmosphere using a box annealing furnace shown in FIG. 5, according to the heating pattern shown in FIG. 3.

As a gas circulation system, an inlet 6, a blower 7, a deoxidizing unit 8, and a dryer 9 (see FIG. 1) were provided in that order, and the flow rate of the circulating gas was controlled at 200 $Nm^3$/hr. A cooler 13 for cooling the gas to about 200° C. or less was provided upstream of blower 7 to protect blower 7 and to improve the dehumidification efficiency of dryer 9. The deoxidizing unit 8 included a catalytic deoxidizing unit 14 containing a platinum-palladium catalyst. Dryer 9 had the same configuration as that in Example 1. A heat exchanger 11 was also provided as in Example 1.

The gas drawn through inlet 6 into the gas treatment system passed through heat exchanger 11 and cooler 13 and was cooled to about 200° C. or less, and entered the catalytic deoxidizing unit 14 in which oxygen reacted with hydrogen to form water. The gas then passed through molecular sieve 9A to remove moisture from the gas. The gas passed through the heat exchanger 11 so that its temperature was controlled to substantially the furnace temperature, and was then fed from the outlet 10 from the heat exchanger 11 to the furnace.

Temper discolor was not observed or visually present on the surface of the annealed sheet. The thickness of the oxide layer was 200 Å to 500 Å.

EXAMPLE 3

Figure 6:
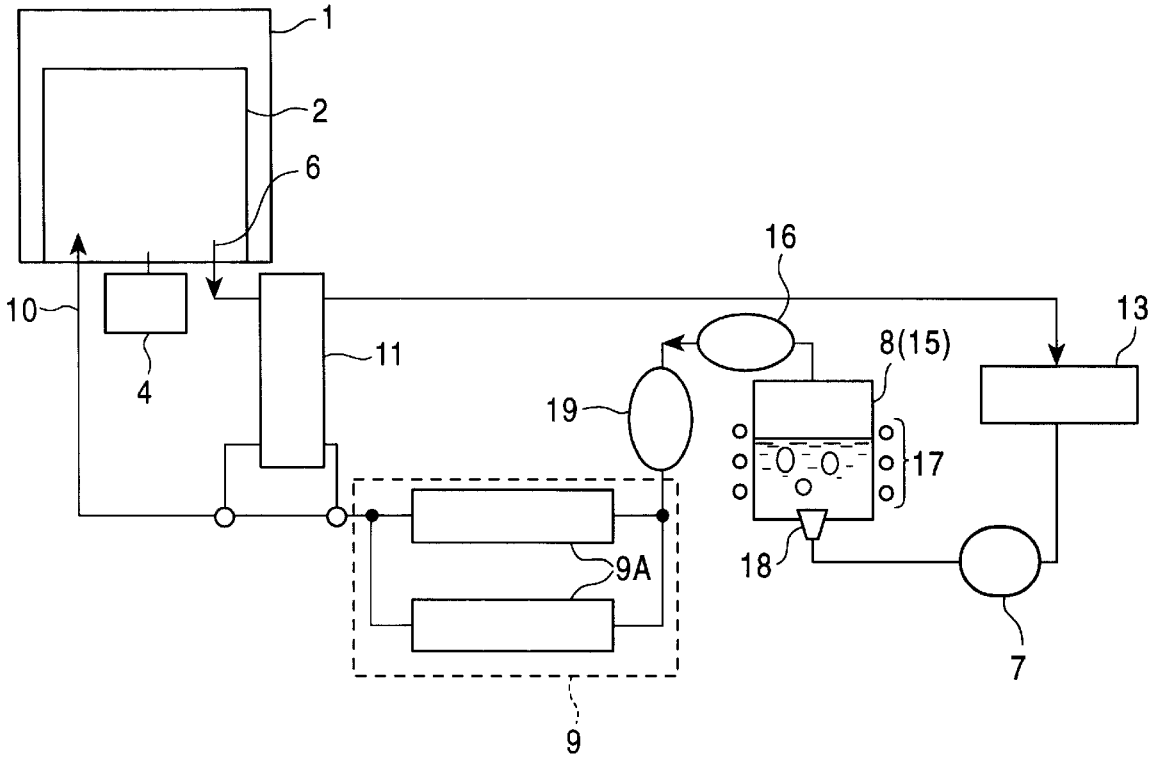
FIG. 6 is a block diagram of another embodiment of a furnace of this invention, as used in Example 3 of the specification.
Figure 7:
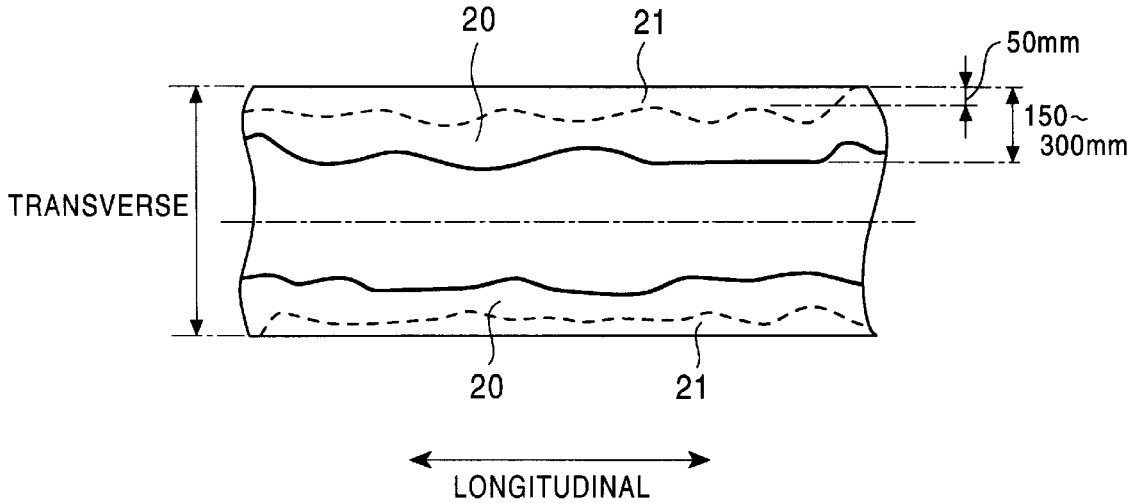
FIG. 7 is a top plan view showing temper discolor on a high-manganese steel sheet annealed in a conventional box annealing furnace.

Three coils (45 tons in total) of cold-rolled ferritic stainless steel (SUS430, JIS-G-4312) sheets having a thickness of 0.8 mm were box-annealed in a pure hydrogen gas atmosphere using a box annealing furnace shown in FIG. 6, using the heating pattern shown in FIG. 3.

As a gas circulation system, an inlet 6, a blower 7, a deoxidizing unit 8, and a dryer 9 were provided in that order, and the flow rate of the circulating gas was controlled at 200 $Nm^3$/hr.

At the inlet side of blower 7, a cooler 13 for cooling the gas to about 450° C. or less was provided to protect dryer 9, and at the inlet side of blower 7, a cooler 19 for cooling the gas to about 200° C. or less was provided to improve dehumidification efficiency of dryer 9.

Deoxidizing unit 8 was an aluminum-bath deoxidizing unit 15 containing melted aluminum. The bath had a heater 17 for melting the aluminum in the bath, and a porous plug was provided for feeding gas (frequently used in steelmaking furnaces) at the bottom. A meshed metal filter 16 for collecting aluminum spatters contained in the gas was provided in the gas feeding path from the top of the bath.

Dryer 9 had the same configuration as that in Example 1. A heat exchanger 11 was also provided as in Example 1.

The gas evacuated from inlet 6 to the gas circulation system passed through heat exchanger 11 and cooler 13 and was cooled to about 450° C. or less, and entered aluminum-bath deoxidizing unit 8, in which oxygen in floating bubbles was removed by the aluminum in the bath. The gas passed through molecular sieve 9A to remove moisture. The gas passed through heat exchanger 11 so that its temperature was controlled to substantially the furnace temperature, and was fed from outlet 10 back into the furnace.

Temper discolor was not observed or present on the surface of the annealed sheet. The thickness of the oxide layer was 200 Å to 500 Å. In the bottom portion of FIG. 3, the solid lines show the dramatic reduction of oxygen content in the gas, as compared to the conventional practice, which is shown by the dash lines. The dew point of the gas was also dramatically reduced, as will be apparent in FIG. 3.

EXAMPLE 4

Figure 12:
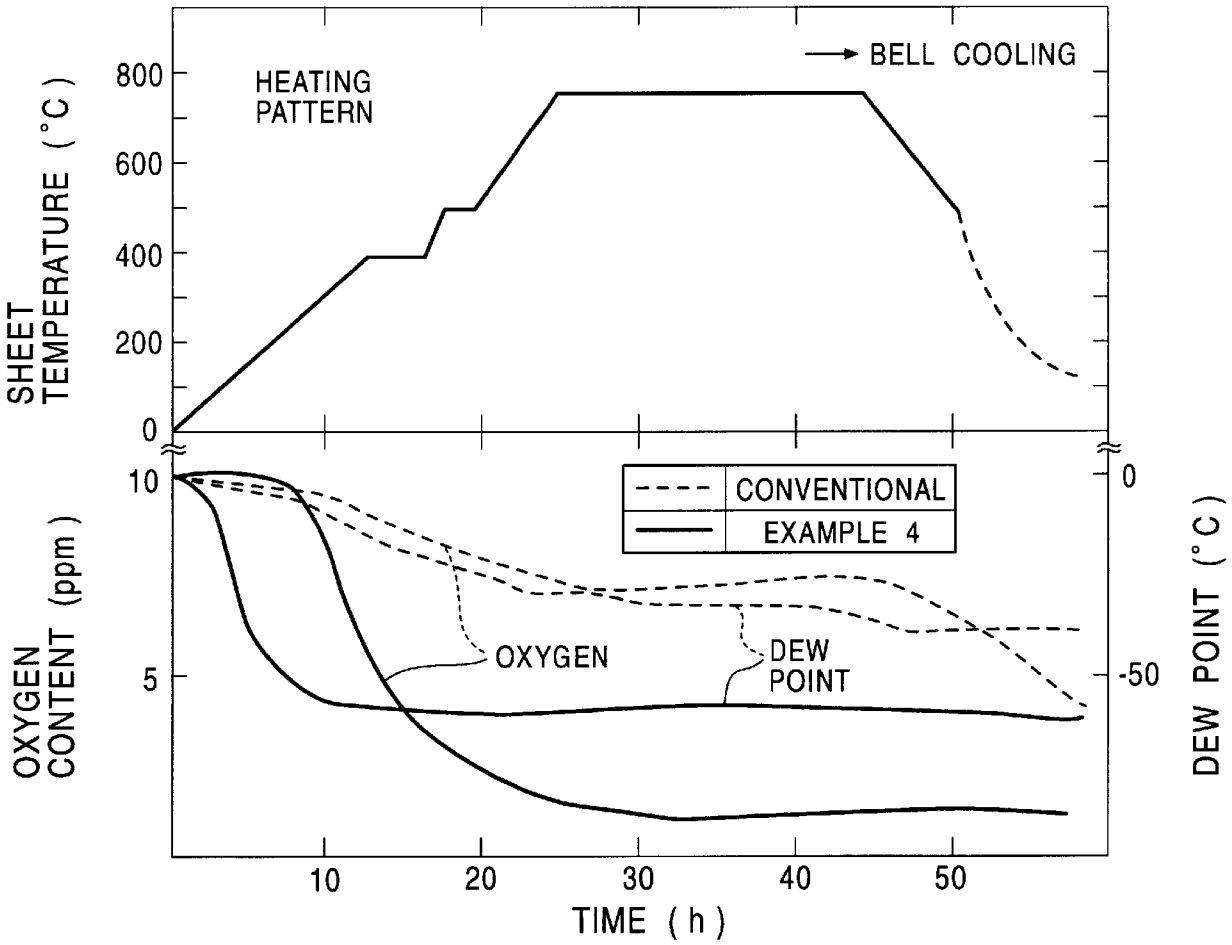
FIG. 12 comprises two combined graphs, one being a graph of a heating pattern in Example 4 of this specification and a conventional heating pattern, and another being a graph showing changes of oxygen content and dew point in the furnace gas.

Three coils (45 tons in total) of cold-rolled heat-resisting steel (SUH409, JIS-G-4312) sheets having a thickness of 1.2 mm and containing 0.2 to 0.7 percent by weight of titanium were box-annealed in a pure hydrogen gas atmosphere using a box annealing furnace shown in FIG. 11, according to the heating pattern shown in FIG. 12. Granular titanium having a average particle size of 10 mm, a ratio S/V of a surface area S ($mm^2$) to a volume V ($mm^3$) of 0.3 $mm^{-1}$ was used as a deoxidizer in an amount of 500 g/ton×45 tons=22.5 kg.

The sharp reductions of oxygen content and dew point in the furnace gas during box annealing are shown in FIG. 12 (solid lines) contrasting with the conventional sheet process (annealed using the annealing furnace shown in FIG. 8) (dash lines). In Example 4, the oxygen content rapidly decreased at approximately 300° C., which is a medium temperature in the heating step, thus indicating activated oxidation. Since oxygen in the furnace gas is effectively removed by granular titanium, the oxygen content in the soaking stage was decreased to approximately 1 to 2 ppm which is very significantly lower than 7 ppm resulting from the conventional method. Thus, the dew point in Example 4 decreased to a level which is approximately 30° C. lower than that obtained by the conventional method.

Figure 13:
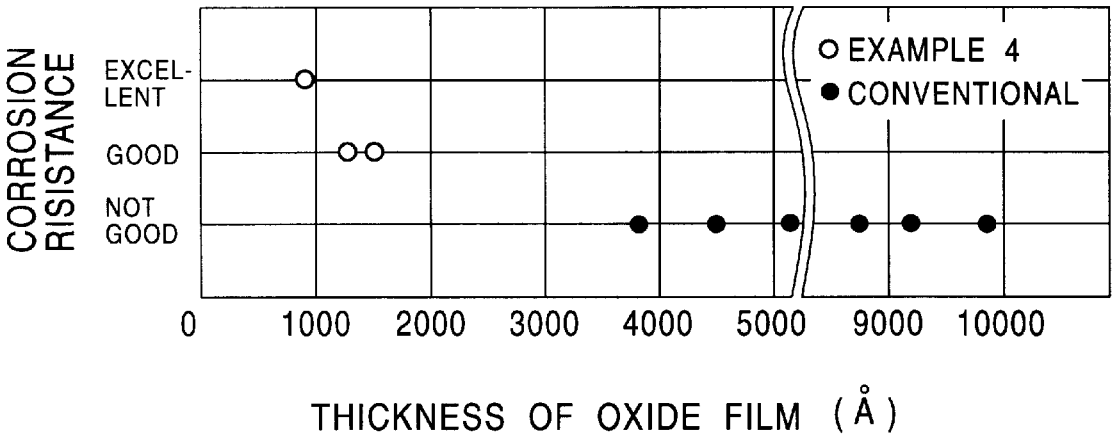
FIG. 13 is a graph showing a relationship between the thickness of an oxide film and corrosion resistance in Example 4, and in a conventional example.

FIG. 13 shows the relationship between the thickness of the oxide film and the corrosion resistance. The thickness of the oxide film was determined at a position which was approximately 100 mm distant from the transverse edge of the sheet, and was measured by glow discharge spectroscopy (GDS). The corrosion resistance was evaluated by the number of corroded areas which were generated by contact with a salt water (5% sodium chloride, aqueous solution, 35° C.) spray test for 4 hours according to JIS-Z-2371. (Evaluation: Excellent for 0/$dm^2$, Good for 1 to 10/$dm^2$, Not Good for 11/$dm^2$ or more)

As shown in FIG. 13, the thickness of the oxide film was 4,000 Å to 10,000 Å for the conventional sheet and 1,000 Å to 1,500 Å for Example 4 (approximately 60 to 90% reduction of the thickness of the conventional sheet). Thus, the resulting sheet is applicable for use not requiring significantly high corrosion resistance.

Figure 9:
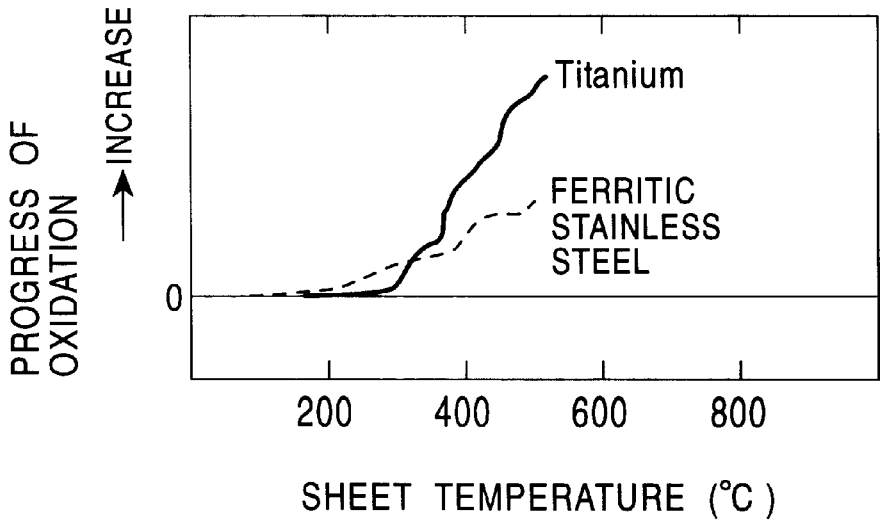
FIG. 9 is a graph showing the relationship between the sheet temperature and the progress of oxidation in a titanium and a ferritic stainless steel.

The thickness of the oxide film in Example 4 was significantly greater than that in Examples 1 to 3. This indicates that the sheet in Example 4 had a slightly lower corrosion resistance. As shown in FIG. 9, when the cold-rolled ferritic stainless steel sheet and granular titanium were heated in the oxidizing atmosphere in the box annealing furnace, titanium was not substantially oxidized until the temperature reached 300° C. but was rapidly oxidized after the temperature exceeded about 300° C.

On the other hand, the ferritic stainless steel was oxidized before the temperature reached 300° C. Thus, the oxide film is believed to have been formed in a low-temperature heating zone from room temperature to about 300° C., without the development of the effects of the added titanium. When the furnace gas was sufficiently deoxidized before heating in Example 4, high corrosion resistance comparable to that in Examples 1 to 3 was achieved.

In accordance with the invention, oxygen in the box annealing furnace is stably removed with high efficiency. Thus, finish annealing of the metal sheet can be achieved in this furnace without temper discolor of the steel or decreased corrosion resistance of its surface. When the gas circulation system for evacuating gas from the box annealing furnace and for refeeding the gas to the furnace included an oxygen removal means for removing oxygen from the gas and a moisture removal means for removing moisture from the gas, oxygen and moisture were more stably removed with greater efficiency. This configuration is applicable to production of products under more severe working conditions.

The box annealing furnace in accordance with the invention can be used in place of a continuous annealing-pickling system in small-batch production of cold-rolled, annealed stainless steel and heat-resisting steel sheets. Alternatively, the box annealing furnace in accordance with the invention may be used as a conventional box annealing system for general cold-rolled steel sheets, so that the same production line can also be used for manufacturing stainless steel and heat-resisting steel sheets. Such a multi-use production system can reduce the considerable expense of investment in the apparatus. Furthermore, the production process in accordance with the invention is simpler than conventional continuous production processes, and thus results in decreased production costs, labor costs and related material costs.

What is claimed is:

1. A box annealing furnace for annealing a metal sheet comprising:

a substantially gas-tight annealing chamber having internal space for maintenance and treating said metal sheet in an atmospheric gas maintained within said chamber, a treatment means in communication with the interior of said chamber for treatment of gas from said atmosphere, said treatment means comprising means for extracting oxygen from said chamber gas and preventing the removed oxygen from re-entering said chamber gas, wherein said means for extracting oxygen comprises a molten deoxidizing metal that is reactive with oxygen.

2. The box annealing furnace according to claim 1, wherein said treatment means is a gas circulation system and comprises both an oxygen removal means for continuously removing oxygen from said furnace and a moisture removal means for continuously removing moisture from said gas.

3. A box annealing furnace for annealing a metal sheet comprising:

a substantially gas-tight annealing chamber having internal space for maintenance and treating said metal sheet in an atmospheric gas maintained within said chamber, a treatment means in communication with the internal space of said chamber for treatment of gas from said atmosphere, said treatment means comprising means for extracting oxygen from said chamber gas and preventing the removed oxygen from re-entering said chamber gas, said means for extracting oxygen comprises a deoxidizing metal that is reactive with oxygen with an affinity that prevents subsequent reduction of said metal and prevents release of said oxygen into said chamber, and said deoxidizing metal has a standard free energy of oxide formation which is equal to or less than about −150 kcal/1 mol of $O_2$ at 200° C.

4. The box annealing furnace according to claim 3, wherein said deoxidizing metal is at least one metal selected from the group consisting of chromium, silicon, titanium, vanadium, manganese, aluminum, lithium, magnesium, and calcium.

5. The box annealing furnace according to claim 3, wherein the ratio S/V of the average surface area S ($mm^2$) to the average volume V ($mm^3$) of said deoxidizing metal is about 0.2 $mm^{-1}$ or more.

6. The box annealing furnace according to claim 3, wherein said deoxidizing metal has a shape selected from the group consisting of a granule having an average diameter of about 30 mm or less, a wire having an average diameter of about 15 mm or less, and a sponge having an average porosity of about 20% or more.

7. The box annealing furnace according to claim 1, wherein said deoxidizing metal has a melting point of about 900° C. or less.

8. The box annealing furnace according to claim 1, wherein said molten metal is aluminum.

9. A box annealing furnace for annealing a metal sheet comprising:

a substantially gas-tight annealing chamber having internal space for maintenance and treating said metal sheet in an atmospheric gas maintained within said chamber, a treatment means in communication with the internal space of said chamber for treatment of gas from said atmosphere, said treatment means comprising means for extracting oxygen from said chamber gas and preventing the removed oxygen from re-entering said chamber gas, said chamber having a hydrogen-containing annealing atmosphere, and said means for extracting oxygen further comprising a platinum-palladium catalyst for reaction of oxygen and hydrogen in said hydrogen-containing annealing atmosphere.

10. The box annealing furnace according to claim 2, wherein the moisture removal means comprises a desiccant positioned for adsorbing water molecules from said atmospheric gas.

11. The box annealing furnace according to claim 2, wherein said moisture removal means comprises a cooling means for cooling said gas to about 200° C. or less.

12. The box annealing furnace according to claim 10, wherein said desiccant is a molecular sieve.

13. The box annealing furnace according to claim 12, wherein said molecular sieve comprises a synthetic zeolite.

14. The box annealing furnace according to claim 1, wherein said metal sheet is a cold-rolled stainless steel or heat-resisting steel sheet, and wherein said means for extracting oxygen is metallic titanium.

15. The box annealing furnace according to claim 1, wherein said treatment means includes means for delivering processed substantially oxygen-free gas to said chamber.

16. A method for annealing a cold-rolled metal sheet comprising:

positioning said metal sheet in a box annealing furnace having a substantially gas-tight chamber having internal space containing a gas maintained within said chamber, heating said metal sheet according to a desired heating pattern, processing said gas continuously for removal of oxygen from said gas, and returning said processed gas, while maintaining said processed gas substantially free of oxygen, into said substantially gas-tight chamber, wherein, in said removal of oxygen from said gas, said gas is treated with a molten deoxidizing metal that is reactive with oxygen and/or a deoxidizing metal having a standard free energy of oxide formation which is equal to or less than about −150 kcal/1 mol of $O_2$ at 200° C.

* * * * *